US008475189B2

(12) United States Patent
Sun

(10) Patent No.: US 8,475,189 B2
(45) Date of Patent: Jul. 2, 2013

(54) CONNECTION UNIT FOR FLUORESCENT TUBES

(75) Inventor: Ming-Hai Sun, Hsinchu (TW)

(73) Assignee: Chuan He Co., Ltd., Taipei (TW)

( * ) Notice: Subject to any disclaimer, the term of this patent is extended or adjusted under 35 U.S.C. 154(b) by 217 days.

(21) Appl. No.: 13/067,374

(22) Filed: May 27, 2011

(65) Prior Publication Data

US 2012/0302079 A1 Nov. 29, 2012

(51) Int. Cl.
*H01R 33/02* (2006.01)

(52) U.S. Cl.
USPC ..... 439/233; 439/240

(58) Field of Classification Search
USPC ..... 439/226, 233, 234, 238, 240, 241, 439/612, 617, 699.2
See application file for complete search history.

(56) References Cited

U.S. PATENT DOCUMENTS

| | | | | |
|---|---|---|---|---|
| 2,303,156 | A * | 11/1942 | Bryant et al. | 439/232 |
| 6,769,789 | B1 * | 8/2004 | Won et al. | 362/260 |
| 6,890,199 | B2 * | 5/2005 | Vogt et al. | 439/238 |
| 7,097,327 | B1 * | 8/2006 | Barton | 362/260 |
| 7,568,930 | B2 * | 8/2009 | Brand et al. | 439/234 |
| 8,333,602 | B2 * | 12/2012 | Galluccio et al. | 439/241 |

* cited by examiner

*Primary Examiner* — Xuong Chung Trans
(74) *Attorney, Agent, or Firm* — Rosenberg, Klein & Lee

(57) ABSTRACT

A connection unit for fluorescent tubes includes a base connected to each of two ends of a light unit and the base has an extension, two conductive plates are connected to two reception areas of the extension, a cover is removably connected to the base and has a room and a recessed area is defined in the top of the cover, a rotatable member is removably connected to the recessed area and has a face board which has a reception hole communicating with the room, a shank is connected to the periphery of the reception hole and the rotatable member is rotatable about an axis of the recessed area, the base and the conductive plates are pulled out from the recessed area and the room respectively.

5 Claims, 5 Drawing Sheets

CONNECTION UNIT FOR FLUORESCENT TUBES

BACKGROUND OF THE INVENTION

1. Field of the Invention

The present invention relates to a connection unit, and more particularly, to a connection unit for fluorescent tubes and the conductive plates and the base can be removed from the unit for convenience of maintenance.

2. Description of Prior Art

A conventional connection unit for fluorescent tubes is shown in FIGS. 4 and 5, and generally includes a light unit 200 with two connection units 300 connected to two ends of the light unit 200, and a florescent tube 100 is connected between the two connection units 300. The light unit 200 includes two slots 201 and an elongate base 202, and the connection unit 300 is connected to the slots 201. The connection unit 300 includes a bottom piece 301 and a top piece 302 which is connected to the bottom piece 301. The bottom piece 301 is inserted into the slots 201 and the top piece 302 has a reception member 302*a* located on the front thereof. A conductive plate 302*b* is located in the top piece 302 so that the two terminals of the fluorescent tube 100 are inserted into the reception member 302*a* and rotated an angle to be in contact with the conductive plate 302*b* to form a circuit loop.

However, the conductive plate 302*b* is located in the top piece 302 and overlapped on the reception member 302*a*, so that they are difficult to be maintained. When in maintenance, the bottom piece 301 and the top piece 302 have to be separated and both of the two pieces 301, 302 are easily broken during separation. Once the two pieces are broken, the whole connection unit 300 has to be replaced.

The present invention intends to provide an improved connection unit wherein the base and the conductive plate can be removed from the cover and the rotatable member is easily removed from the unit so as to be easily maintained.

SUMMARY OF THE INVENTION

The present invention relates to a connection unit connected to each of two ends of a light unit and the connection unit comprises a base connected to the light unit and has an extension extending from the top thereof. The extension has two support rods and a separation rod. The two support rods and the separation rod define two reception areas on the extension and two conductive plates are engaged with the two reception areas. A first connecting portion is located between the base and the extension. A cover is removably connected to the base and has a room defined therein. The extension is inserted into the room. A recessed area is defined in the top of the cover and a second connecting portion is located on the underside of the cover. The first connecting portion is connected to the second connecting portion when the extension is inserted into the room. A rotatable member is removably connected to the recessed area of the cover and has a substantially circular face board which has a reception hole defined therein. The reception hole communicates with the room. A shank is connected to the periphery of the reception hole and the rotatable member is rotatable about an axis of the recessed area. The base and the conductive plates are pulled out from the cover from the recessed area and the room respectively for convenience of maintenance.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
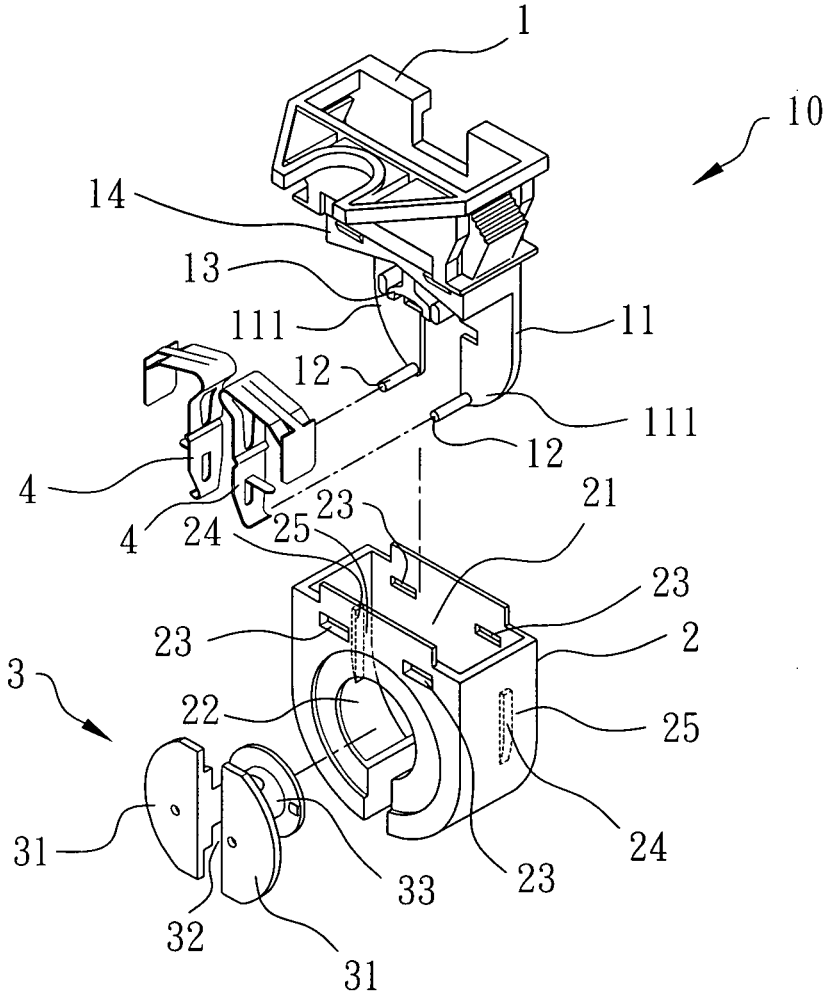
FIG. 1 is an exploded view to show the connection unit of the present invention.

Referring to FIGS. 1 to 4, the connection unit 10 of the present invention is connected to an engaging hole 20*a* in each of two ends of a light unit 20 and comprises a base 1. A fluorescent tube 30 is connected between the two bases 1. The base 1 has an extension 11 extending from the top thereof. In this embodiment, the extension 11 is U shaped. The extension 11 has two support rods 12 and a separation rod 13 extending therefrom, the two support rods 12 and the separation rod 13 define two reception areas 111 on the extension 11. Two conductive plates 4 are engaged with the two reception areas 111. A first connecting portion 14 is located between the base 1 and the extension 11. In this embodiment, the first connecting portion 14 comprises multiple bosses.

The cover 2 is removably connected to the base 1 and has a room 21 defined therein. The extension 11 is inserted into the room 21. A recessed area 22 is defined in the top of the cover 2 and a second connecting portion 23 is located on the underside of the cover 2. The first connecting portion 14 is connected to the second connecting portion 23 when the extension 11 is inserted into the room 21. In this embodiment, the second connecting portion 23 has multiple holes for receiving the bosses.

A rotatable member 3 is removably connected to the recessed area 22 of the cover 2 and has a substantially circular face board 31 which has a reception hole 32 defined therein. The reception hole 32 communicates with the room 21 so that the terminals of the fluorescent tube 30 are inserted into the reception hole 32. A shank 33 is connected to the periphery of the reception hole 32. The recessed area 22 accommodates the face board 31 and the shank 33 so that the rotatable member 3 is rotatable about the axis of the recessed area 22. By the rotation, the fluorescent tube 30 and the conductive plates 4 are in contact with ach other to form a circuit loop. The base 1 and the conductive plates 4 can be pulled out from the cover 2 from the recessed area 22 and the room respectively for convenience of maintenance.

Each of two sides of the cover 2 has a protrusion 24 and a slot 25 is defined by the protrusions 24 and the underside of the cover 2 so that the extension 11 is slid along the slot 25.

Figure 2:
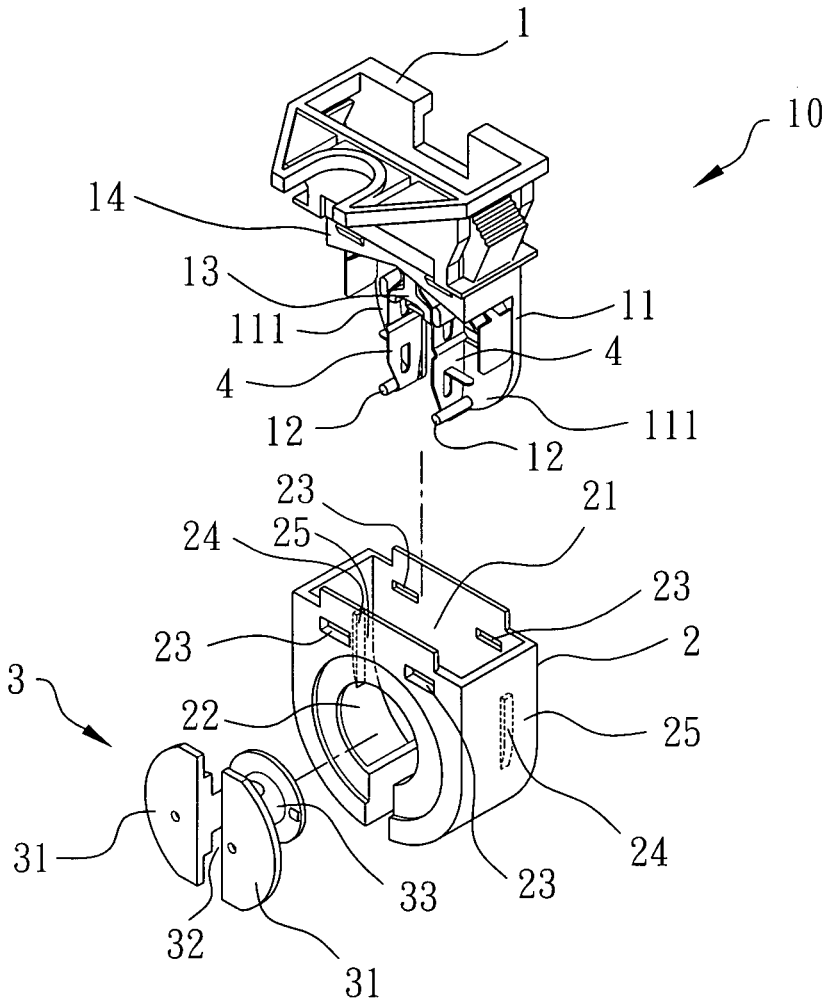
FIG. 2 is another exploded view to show the connection unit of the present invention, wherein the conductive plates are connected to the extension of the base.
Figure 3:
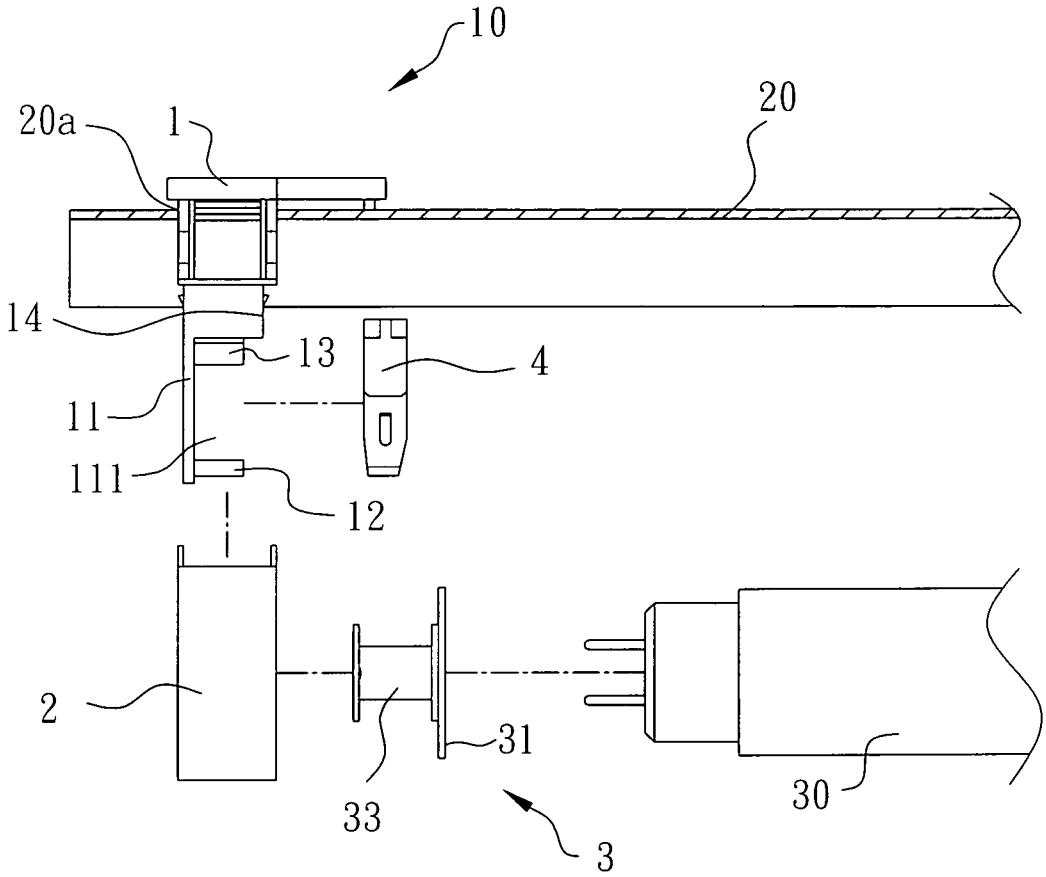
FIG. 3 shows that a fluorescent tube is to be connected to the connection unit on the light unit.
Figure 4:
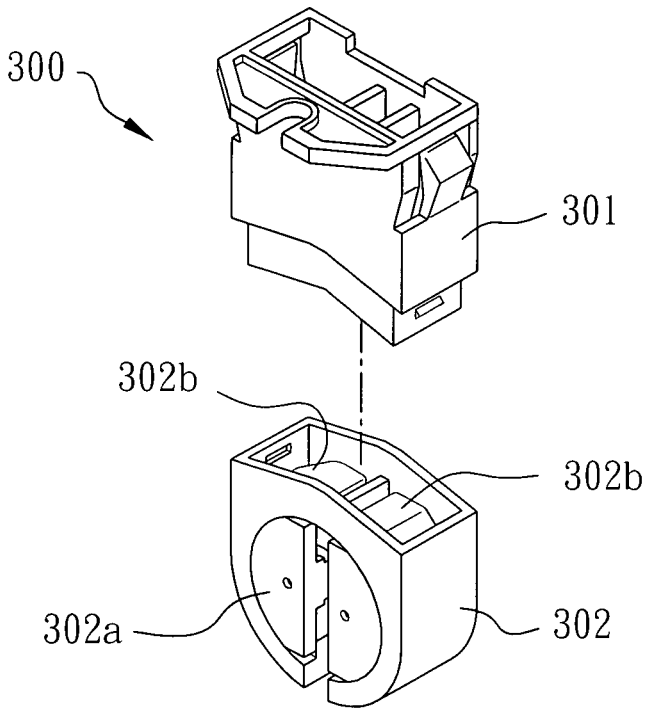
FIG.4 PRIOR ART
FIG. 4 is an exploded view to show the conventional connection unit.
Figure 5:
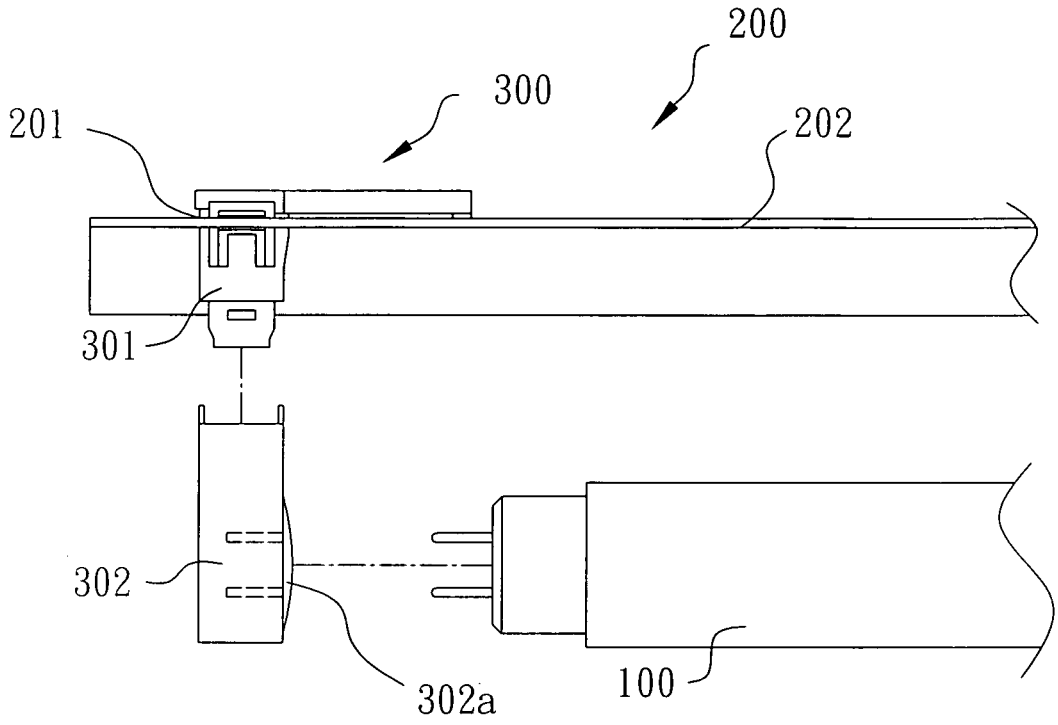
FIG.5 PRIOR ART
FIG. 5 shows that a fluorescent tube is to be connected to the conventional connection unit on the light unit.

As shown in FIG. 3, the connection unit 10 is connected to the engaging holes 20*a* of the light unit 20 so as to connect the fluorescent tube 30 to the light unit 20. When in maintenance, the first connecting portion 14 is separated from the second connecting portion 23 as shown in FIG. 2 so that the base 1 can be pulled out from the cover 2 and the and the conductive plates 4 can be fixed or replaced.

The users only need to pull the base 1 to access the conductive plates 4, and the rotatable member 3 can also be removed from the cover 2 to be maintained. The specific arrangement effectively reduces the risk of breaking the parts as described in the conventional connection unit. Furthermore, the extension 11 reinforces the structural strength of the connecting unit 10.

While we have shown and described the embodiment in accordance with the present invention, it should be clear to those skilled in the art that further embodiments may be made without departing from the scope of the present invention.

What is claimed is:

1. A connection unit connected to each of two ends of a light unit, and comprising:

a base adapted to be connected to the light unit and having an extension extending from a top thereof, the extension having two support rods and a separation rod, the two support rods and the separation rod defining two reception areas on the extension, two conductive plates engaged with the two reception areas, a first connecting portion located between the base and the extension;

a cover removably connected to the base and having a room defined therein, the extension being inserted into the room, a recessed area defined in a top of the cover and a second connecting portion located on an underside of the cover, the first connecting portion connected to the second connecting portion when the extension is inserted into the room, and a rotatable member removably connected to the recessed area of the cover and having a substantially circular face board which has a reception hole defined therein, the reception hole communicating with the room, a shank connected to a periphery of the reception hole and the rotatable member being rotatable about an axis of the recessed area, the base and the conductive plates being pulled out from the cover from the recessed area and the room respectively.

2. The connection unit as claimed in claim 1, wherein the first connecting portion comprises multiple bosses and the second connecting portion has multiple holes for receiving the bosses.

3. The connection unit as claimed in claim 1, wherein each of two sides of the cover has a protrusion, a slot is defined by the protrusions and the underside of the cover so that the extension is slid along the slot.

4. The connection unit as claimed in claim 1, wherein the recessed area accommodates the face board and the shank.

5. The connection unit as claimed in claim 1, wherein the extension is U shaped.

* * * * *